US008186509B2

(12) United States Patent
Samelson

(10) Patent No.: US 8,186,509 B2
(45) Date of Patent: May 29, 2012

(54) DISPLAY HANGER FOR CURTAIN ROD

(75) Inventor: David Samelson, New York, NY (US)

(73) Assignee: Ex-Cell Home Fashions, Inc., New York, NY (US)

( * ) Notice: Subject to any disclaimer, the term of this patent is extended or adjusted under 35 U.S.C. 154(b) by 0 days.

(21) Appl. No.: 13/159,960

(22) Filed: Jun. 14, 2011

(65) Prior Publication Data

US 2011/0240814 A1 Oct. 6, 2011

Related U.S. Application Data

(63) Continuation of application No. 11/713,282, filed on Mar. 2, 2007, now abandoned.

(51) Int. Cl.
*F16M 13/02* (2006.01)

(52) U.S. Cl. ..... 206/326; 206/349; 206/806

(58) Field of Classification Search ..... 206/326, 206/349, 806; 211/54.1, 57.1, 59.1, 7, 70, 211/70.1

See application file for complete search history.

(56) References Cited

U.S. PATENT DOCUMENTS

| | | | | |
|---|---|---|---|---|
| 2,759,756 | A * | 8/1956 | Sikora | 294/31.2 |
| 3,275,366 | A | 9/1966 | Hidding | |
| 3,311,252 | A | 3/1967 | Swartwood et al. | |
| 3,408,758 | A | 11/1968 | Doring | |
| 3,463,536 | A | 8/1969 | Updegraff et al. | |
| 4,062,450 | A * | 12/1977 | Carter | 206/485 |
| 4,090,729 | A | 5/1978 | Erickson | |
| 4,450,961 | A | 5/1984 | Bies et al. | |
| 4,634,005 | A | 1/1987 | Kulzer et al. | |
| D291,746 | S | 9/1987 | Evans | |
| D293,297 | S | 12/1987 | Wood | |
| D293,856 | S | 1/1988 | Evans | |
| 4,753,350 | A | 6/1988 | Seymour | |
| D313,550 | S | 1/1991 | Lorincz | |
| 5,484,056 | A | 1/1996 | Wood | |
| 5,695,232 | A | 12/1997 | Tipp | |
| 5,752,732 | A * | 5/1998 | Beaton et al. | 294/27.1 |
| D429,461 | S | 8/2000 | Rowlay | |
| 6,241,092 | B1 | 6/2001 | Vasudeva | |
| 6,394,517 | B1 * | 5/2002 | Borg | 294/31.2 |
| 6,425,482 | B1 | 7/2002 | Chiang | |
| 6,543,629 | B1 | 4/2003 | Samelson | |
| 6,672,555 | B2 | 1/2004 | Chang | |
| 6,679,379 | B1 | 1/2004 | Kao | |
| 6,827,210 | B2 | 12/2004 | Chen | |
| 6,883,664 | B2 | 4/2005 | Lee | |
| 7,097,061 | B2 | 8/2006 | Simpson, Jr. et al. | |
| 7,124,900 | B2 | 10/2006 | Hu | |
| 7,131,535 | B2 | 11/2006 | Hernandez, Jr. et al. | |
| D563,209 | S | 3/2008 | Samelson | |

(Continued)

*Primary Examiner* — Steven A. Reynolds
*Assistant Examiner* — King M Chu
(74) *Attorney, Agent, or Firm* — Alston & Bird LLP

(57) ABSTRACT

A hanger is provided for mounting a curtain rod, such as a shower curtain tension rod, on a display. The hanger includes a body and a resilient collar, pivotally connected to the body, for engaging the rod in a "snap-fit" fashion. The body has a first opening adapted to receive the curtain rod end and a second opening adapted to be engaged by a prong of the display, to mount the curtain rod on the display. The curtain rod end may include a part, such as a finial, with an exterior surface having a contour. The first opening has a shape substantially corresponding to that contour. The second opening preferably includes three recesses such that conventional single prong and double prong displays can be accommodated.

19 Claims, 3 Drawing Sheets

U.S. PATENT DOCUMENTS

| | | | |
|---|---|---|---|
| 7,424,951 | B2 | 9/2008 | Hu |
| 2001/0035488 | A1 | 11/2001 | Cizek |
| 2002/0084240 | A1 | 7/2002 | Yu-Hsien |
| 2002/0113183 | A1 | 8/2002 | Mattesky |
| 2002/0117411 | A1 | 8/2002 | Ortiz |
| 2005/0224673 | A1 | 10/2005 | Wang |
| 2005/0230587 | A1 | 10/2005 | Yang |

* cited by examiner 36
38
34
32
40
B
30
18
16
23
5
24
26
22
A
10
D
C
33
42

32
B
30
22
3
16
18
14
24
26
12
D

B
23
A
22
20
21

DISPLAY HANGER FOR CURTAIN ROD

CROSS-REFERENCE TO RELATED APPLICATIONS

This application is a continuation of U.S. patent application Ser. No. 11/713,282, entitled "Display Hanger for Curtain Rod," filed on Mar. 2, 2007 now abandoned, which is incorporated herein in its entirety by reference.

BACKGROUND OF THE INVENTION

1. Field of the Invention

The present invention relates to merchandising of curtain rods and more particularly to a hanger for mounting a curtain rod on a conventional display of the type consisting of one or more horizontally extending prongs.

2. Description of Prior Art Including Information Disclosed Under 37 Cfr 1.97 and 1.98

Curtain rods of various types, such as those consisting of a cylindrical shaft of fixed length made of wood or metal, and two-section metal tension rods of adjustable length, are well known in the art. They are utilized for various purposes, such as supporting clothes hangers in closets, hanging window treatments of a variety of different kinds adjacent window frames, as well as for suspending shower curtains and shower curtain liners within bathtub enclosures. Fixed length curtain rods are available with plain ends designed to be supported by brackets fixed to walls. Variable length tension rods are provided with pressure pads or suction cups designed to be situated between opposing vertical surfaces. Often, the curtain rods are available with enlarged decorative ends, known as finials. The finials may carry the pressure pads or suction cups when used on tension rods.

Because such curtain rods are by nature long and narrow, they are difficult to display in a satisfactory manner at retail. They may be arranged upright in some sort of an open container on the store floor or may be placed horizontally on a rack or shelf. However, neither of those options is considered to be optimum from a merchandising point of view.

BRIEF SUMMARY OF THE INVENTION

The present invention relates to an inexpensive and reusable display hanger designed to releasably engage the end of a curtain rod and to suspend the curtain rod from a conventional single or double prong display bracket in a manner which makes it easy for a potential consumer to examine and choose a curtain rod for purchase.

The hanger of the present invention includes two parts. The first part takes the form of a collar made of resilient material such as plastic that can releasably engage the curtain rod in a "snap-fit" fashion proximate the end thereof. The second part includes two spaced openings, one to receive the curtain rod end and the other capable of receiving one or two prongs from a conventional display bracket. To insure that the hanger will not accidentally dislodge from the display as it swings, the parts are pivotally connected together.

It is, therefore, a prime object of the present invention to provide a display hanger for merchandising curtain rods at retail.

It is another object of the present invention to provide a display hanger for a curtain rod which can be used with single or double prong display brackets.

It is another object of the present invention to provide a display hanger for a curtain rod which permits the rod to pivot relative to the display bracket.

It is another object of the present invention to provide a display hanger for a curtain rod that is inexpensive to manufacture and assemble.

It is another object of the present invention to provide a display hanger for a curtain rod that is esthetically pleasing.

It is another object of the present invention to provide a display hanger for a curtain rod that can be used with curtain rods having ends with finials or irregular shapes.

It is another object of the present invention to provide a display hanger for a curtain rod that is reusable.

In accordance with one aspect of the present invention, a hanger is provided for mounting a curtain rod on a display prong. The curtain rod has an end. The hanger includes a body and means connected to the body for engaging the rod. The body has a first opening adapted to receive the curtain rod end and a second opening adapted to be engaged by a prong of the display, to mount the curtain rod on the display.

The first opening is spaced from the second opening.

The curtain rod end may include a part, such as a finial, with an exterior surface having a contour. The first opening has a shape substantially corresponding to that contour.

The hanger includes means for connecting the body and the rod engaging means. Preferably, those means are pivotal connecting means.

The rod engaging means preferably takes the form of means for releasably engaging the cylindrical portion of the rod. It preferably includes a collar. The collar is formed of resilient plastic and comprises an arcuate member with spaced ends.

The second opening includes at least one recess. The prong of the display is adapted to be received in the recess. Preferably more than one recess is provided to accommodate displays with two spaced prongs. Most preferably, three recesses are provided such that single prong and double prong displays can be accommodated.

The hanger is preferably made of plastic.

The hanger may be a shower curtain rod.

In accordance with another aspect of the present invention, a curtain rod and a hanger for mounting the curtain rod on a display are provided in combination. The curtain rod has an end. The hanger includes a body and means connected to the body for engaging the rod. The body has a first opening adapted to receive the shower curtain rod end and a second opening adapted to be engaged by a prong of the display, to mount the curtain rod on the display.

The first opening of the body is spaced from the second opening.

The curtain rod end may include a part, such as a finial, with an exterior surface having a contour. The first opening has a shape substantially corresponding to that contour.

The hanger includes means for connecting the body and the rod engaging means. Preferably, those means are pivotal connecting means.

The rod engaging means preferably takes the form of means for releasably engaging the cylindrical portion of the rod. It preferably includes a collar. The collar is formed of resilient plastic and comprises an arcuate member with spaced ends.

The second opening of the body includes at least one recess. The prong of the display is adapted to be received in the recess. Preferably more than one recess is provided to accommodate display brackets with two spaced prongs. Most preferably, three recesses are provided such that single prong and double prong display brackets can be accommodated.

The hanger is preferably made of plastic.

The hanger may be a shower curtain rod, including a shower curtain tension rod.

BRIEF DESCRIPTION OF THE SEVERAL VIEWS OF DRAWINGS

To these and to such other objects that may hereinafter appears, the present invention relates to display hanger for a curtain rod as described in detail in the following specification, and recited in the annexed claims, taken together with the accompanying drawings, in which like numerals refer to like parts and in which:

DETAILED DESCRIPTION OF THE INVENTION

Figure 6:
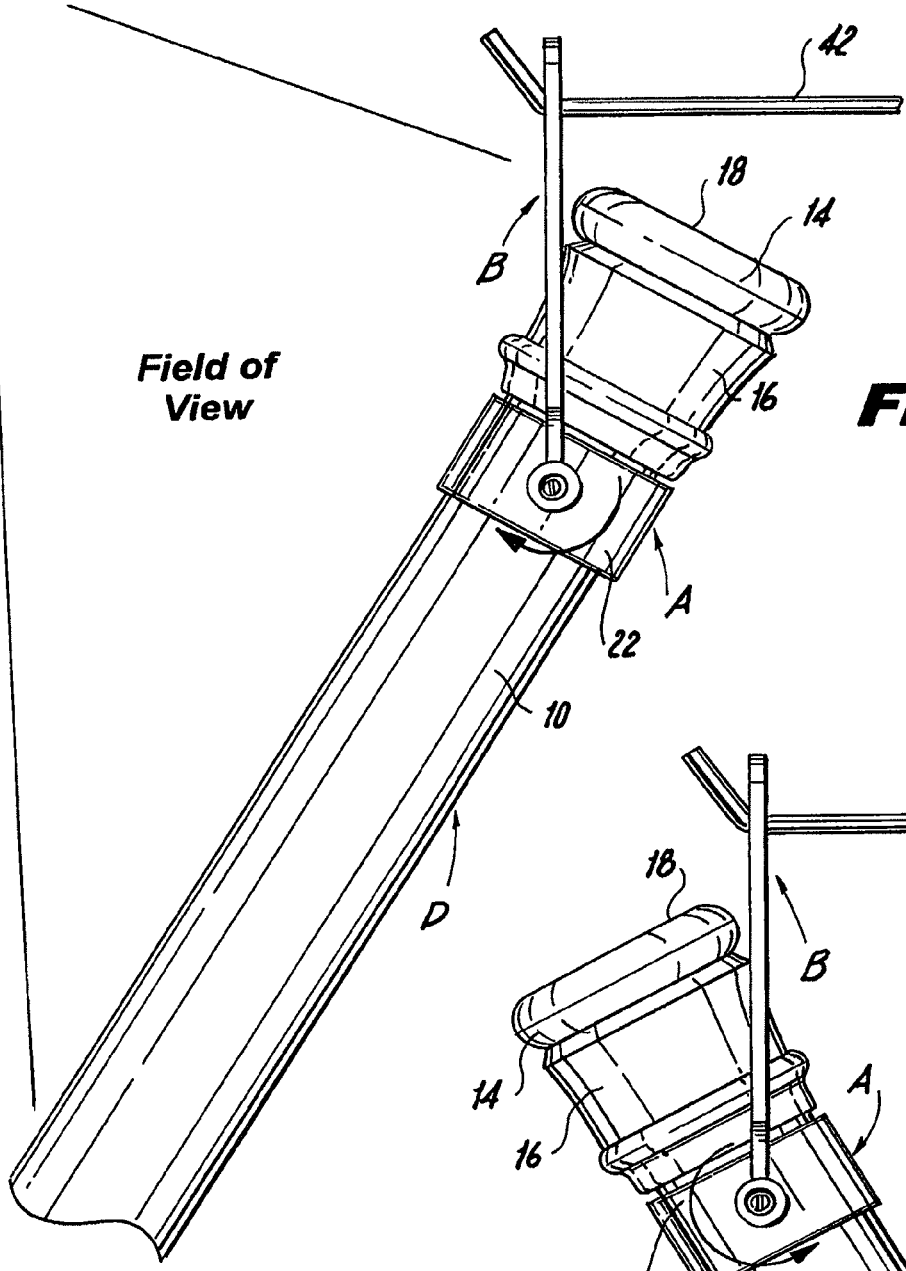
FIG. 6 is a side view of the hanger suspended from a display bracket showing the rod pivoted in the forward direction.
Figure 7:
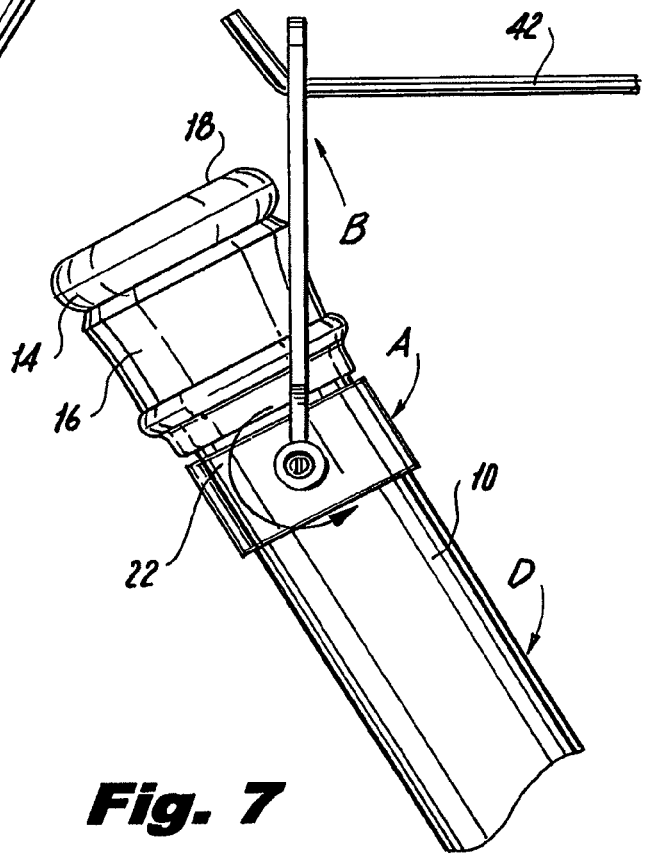
FIG. 7 is a view similar to FIG. 6 but showing the rod pivoted in the opposite direction.

As seen in the drawings, the hanger of the present invention includes a rod engaging part, generally designated A, and a body part, generally designated B, adapted to accommodate the end of the curtain rod and receive one or more prongs of a conventional display bracket, generally designated C. Parts A and B are preferably connected in a manner that permits part A to pivot relative to part B, as is illustrated in FIGS. 6 and 7.

The hanger is designed for use with a curtain rod, generally designated D, which includes a cylindrical shaft 10 with an end 12 having a finial 14 fixed thereto. Finial 14 has an irregular exterior surface 16 with a particular contour for decorative purposes and a planar end section 18 which may include a pressure pad.

Rod engaging part A comprises a collar 22 formed of an arcuate member made of resilient plastic. Collar 22 has spaced ends 24, 26 defining an opening or gap therebetween. The resiliency of the collar material permits end 24, 26 to be moved apart from their normal relative position to receive shaft 10 of rod C at a point below finial 14 and then to return to their normal position to engage the shaft securely. Thus, rod D "snap-fits" into the collar. Ends 24 and 26 are preferably rounded, as best seen in FIG. 2, to function as cams to facilitate the movement of the rod into the collar.

Figures 1, 2, 3:
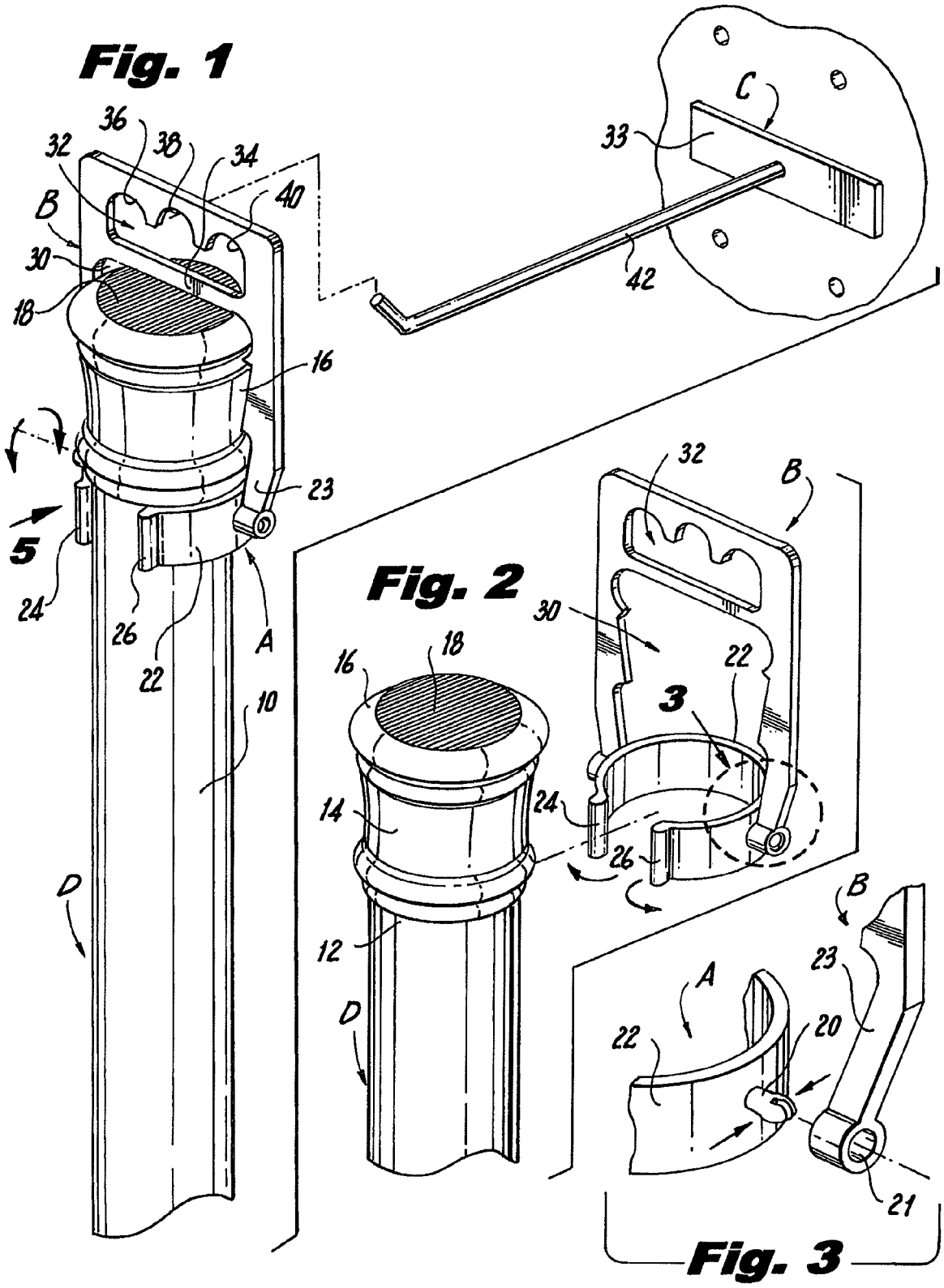
FIG. 1 is an isometric view of the hanger of the present invention as it would appear in engagement with a curtain rod, exploded from a single prong display bracket.
FIG. 2 is an exploded isometric view of the hanger illustrating how it engages a curtain rod.
FIG. 3 is an enlarged exploded partial view of the pivot connection of the parts.

FIG. 3 illustrates the means for pivotally connecting the collar to body part B. That means takes the form of oppositely directed protrusions 20 extending from the exterior surface of the collar, only one of which is visible in that figure. Each protrusion 20 has a bifurcated end that permits it to be received in an internal channel 21 formed in the lower portion of one of the legs 23 of body part B. Accordingly, collar 22 is situated between the legs 23 of the body part B, with the protrusions 20 received in the channels 21 of the respective legs 23, in a manner that permits the collar to freely pivot relative to body part B.

Body part B has a first opening 30 with an edge that has a contour corresponding to the contour of the curtain rod end, in this case, exterior surface 16 of finial 14. It also has a second opening 32 spaced from first opening 30.

Figures 4, 5:
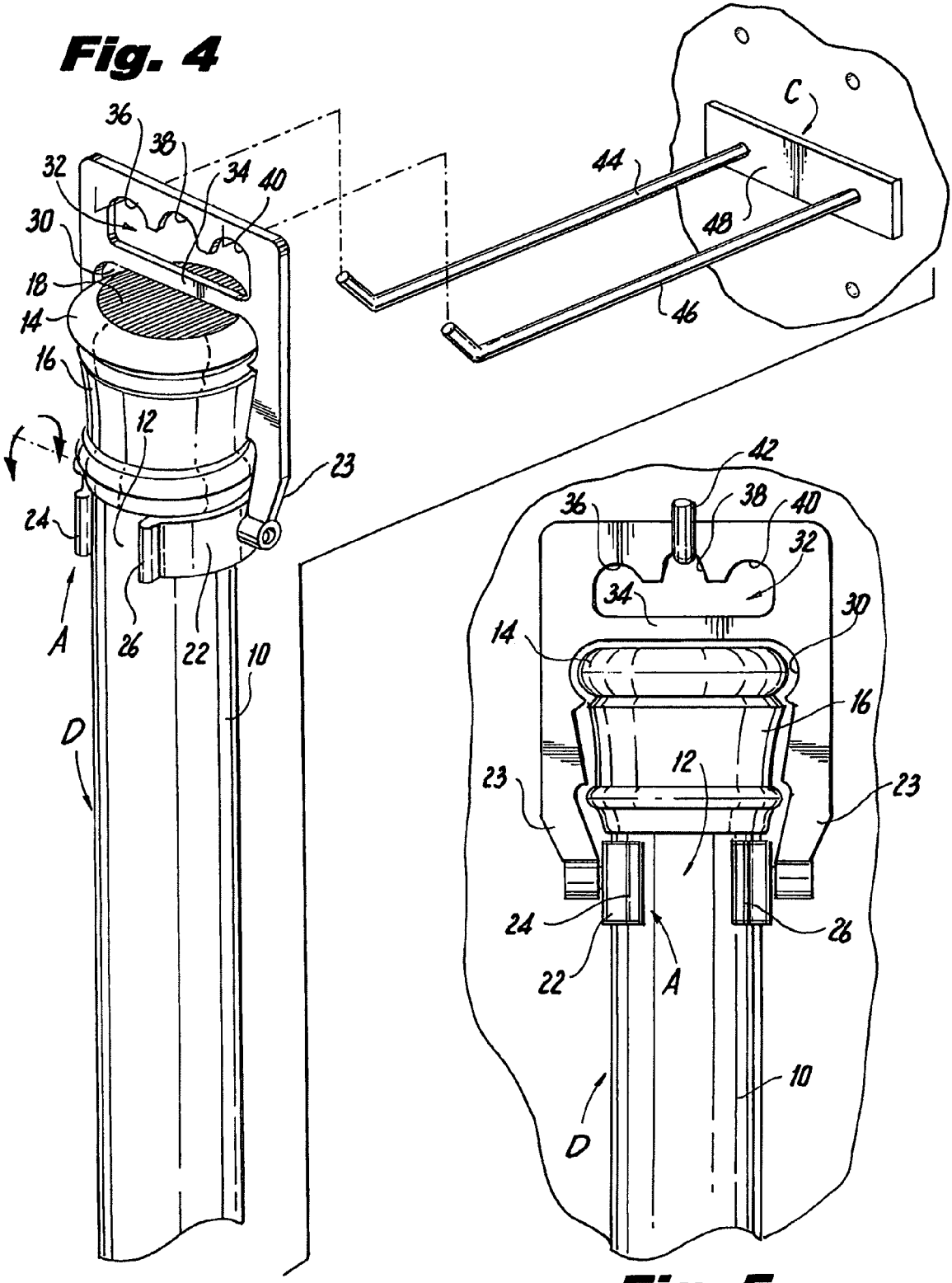
FIG. 4 is a view similar to FIG. 1 illustrating how the hanger is used with a double prong display bracket.
FIG. 5 is a front elevation view of the hanger as it appears when suspended from a single prong bracket.

Second opening 32 has a lower substantially straight edge 34 and upper edge including three upwardly directed spaced recesses 36, 38 and 40. Second opening 32 is designed to receive the prong 42 of a single prong display bracket 33 in recess 38, as illustrated in FIGS. 1 and 5, or two prongs 44, 46 of a double prong display bracket 48, in recesses 36 and 40, respectively, as shown in FIG. 4. Accordingly, the hanger can be used with both single prong and double prong conventional display brackets.

It will now be appreciated that the present invention relates to a hanger for mounting a curtain rod, such as a shower curtain rod, on a display and can accommodate conventional display brackets with either single or double prongs. The hanger includes a body and means, in the form of a resilient collar, pivotally connected to the body for engaging the rod in a "snap-fit" fashion. The body has a first opening adapted to receive the curtain rod end and a second opening adapted to be engaged by a prong of the display, to mount the curtain rod on the display.

The curtain rod end may include a part, such as a finial, with an exterior surface having a contour. The first opening has a shape substantially corresponding to that contour.

The second opening preferably includes three recesses such that single prong and double prong displays can be accommodated.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

I claim:

1. A combination curtain rod and hanger for displaying the curtain rod on a display bracket comprising:

a curtain rod having a shaft and an end, wherein the end comprises a finial having a contour; and a hanger comprising:

a collar comprising an arcuate member having spaced ends, wherein the arcuate member is configured to releasably engage the shaft of the curtain rod, and wherein a radius of the arcuate member defines a first plane; and a body attached to the collar and comprising a first portion and a second portion, the first portion defining a first opening configured to receive the end of the curtain rod and the second portion defining a second opening configured to receive at least one prong of the display bracket, wherein the first and second portions define a second plane different from the first plane, wherein, in a first position, the ends of the arcuate member define a distance therebetween that is smaller than a diameter of the shaft, wherein the ends are configured to move away from each other as the shaft is being received by the collar to accommodate the diameter of the shaft, thereby increasing the distance between the ends, and wherein the ends are configured to return towards the first position once the shaft is engaged with the collar, wherein the first portion of the body includes a first leg and a second leg extending between the second portion of the body and the collar, the first leg defining a first inner edge and the second leg defining a second inner edge, the first portion further defining a third inner edge extending between the first and second inner edges, the third inner edge being substantially linear and lying substantially within the second plane and the first and second inner edges being symmetrical about a central axis of the body and lying within the second plane, wherein the first and second inner edges are separated by a distance that is greater than the diameter of the shaft to accommodate the contour of the finial of the curtain rod.

2. The combination of claim 1, wherein the arcuate member defines an inner surface and an outer surface, and wherein the inner surface is substantially smooth.

3. The combination of claim 1, wherein each of the first and second inner edges defines a contour corresponding to a contour of the end of the curtain rod.

4. The combination of claim 1, wherein the second opening comprises three recesses.

5. The combination of claim 1, wherein the collar is configured to be resilient such that the arcuate member forms a snap-fit with the shaft of the curtain rod.

6. The combination of claim 1, wherein the ends of the arcuate member are rounded and function as cams to facilitate movement of the curtain rod into the collar.

7. The combination of claim 1, wherein the body is separate from the collar and is configured to pivotally engage the collar such that the collar is freely rotatable about an axis of the pivotal engagement.

8. The combination of claim 7, wherein the collar is configured to be oriented substantially perpendicularly to the body when the collar is engaged to the curtain rod, the body is pivotally engaged to the collar portion, and the body portion is mounted on the display bracket.

9. The combination of claim 7, wherein the collar includes two oppositely directed protrusions, and wherein each of the first leg and the second leg of the body defines a channel configured to receive one of the two oppositely directed protrusions of the collar.

10. The combination of claim 9, wherein each protrusion defines a bifurcated end.

11. A combination curtain rod and hanger for displaying the curtain rod on a display bracket comprising:

a curtain rod having a shaft and an end, wherein the end comprises a finial having a contour ; and a hanger comprising:

a collar comprising an arcuate member having spaced ends, wherein the arcuate member is configured to releasably engage the shaft of the curtain rod, and wherein a radius of the arcuate member defines a first plane; and a body attached to the collar and comprising a first portion and a second portion, the first portion defining a first opening configured to receive the end of the curtain rod and the second portion defining a second opening configured to receive at least one prong of the display bracket, wherein the first and second portions define a second plane different from the first plane, wherein, in a first position, the ends of the arcuate member define a distance therebetween that is smaller than a diameter of the shaft, wherein the ends are configured to move away from each other as the shaft is being received by the collar to accommodate the diameter of the shaft, thereby increasing the distance between the ends, and wherein the ends are configured to return toward the first position once the shaft is engaged with the collar, wherein the first portion of the body includes a first leg and a second leg extending between the second portion of the body and the collar, the first leg defining a first inner edge and the second leg defining a second inner edge, the first portion further defining a third inner edge extending between the first and second inner edges, wherein the first, second and third inner edges define the first opening, wherein the body and the collar are configured such that the first plane is substantially perpendicular to the second plane when the collar is engaged to the curtain rod and the body is mounted on the display bracket, wherein the first and second inner edges are separated by a distance that is greater than the diameter of the shaft to accommodate the contour of the finial of the curtain rod.

12. The combination of claim 11, wherein the third inner edge is substantially linear and lies substantially within the second plane and the first and second inner edges are symmetrical about a central axis of the body and lie within the second plane.

13. The combination of claim 11, wherein the arcuate member defines an inner surface and an outer surface, and wherein the inner surface is substantially smooth.

14. The combination of claim 11, wherein each of the first and second inner edges defines a contour corresponding to a contour of the end of the curtain rod.

15. The combination of claim 11, wherein the second opening comprises three recesses.

16. The combination of claim 11, wherein the collar is configured to be resilient such that the arcuate member forms a snap-fit with the shaft of the curtain rod.

17. The combination of claim 11, wherein the body is separate from the collar and is configured to pivotally engage the collar such that the collar is freely rotatable about an axis of the pivotal engagement.

18. The combination of claim 17, wherein the collar includes two oppositely directed protrusions, and wherein each of the first leg and the second leg of the body defines a channel configured to receive one of the two oppositely directed protrusions of the collar.

19. The combination of claim 18, wherein each protrusion defines a bifurcated end.

* * * * *